US009695011B2

(12) United States Patent
Hugel et al.

(10) Patent No.: US 9,695,011 B2
(45) Date of Patent: Jul. 4, 2017

(54) ELEVATOR WITH A SAFETY BRAKE

(71) Applicant: Inventio AG, Hergiswil (CH)

(72) Inventors: Stefan Hugel, Meggen (CH); Daniel Fischer, St-Triphon/VD (CH)

(73) Assignee: Schindler Aufzüge AG, Hergiswil (CH)

( * ) Notice: Subject to any disclaimer, the term of this patent is extended or adjusted under 35 U.S.C. 154(b) by 83 days.

(21) Appl. No.: 14/442,414

(22) PCT Filed: Nov. 5, 2013

(86) PCT No.: PCT/EP2013/073057
§ 371 (c)(1),
(2) Date: May 13, 2015

(87) PCT Pub. No.: WO2014/075954
PCT Pub. Date: May 22, 2014

(65) Prior Publication Data

US 2016/0272464 A1 Sep. 22, 2016

(30) Foreign Application Priority Data

Nov. 13, 2012 (EP) ..... 12192317

(51) Int. Cl.
*B66B 5/18* (2006.01)
*B66B 5/22* (2006.01)
*B66B 9/00* (2006.01)

(52) U.S. Cl.
CPC ..... *B66B 5/18* (2013.01); *B66B 5/22* (2013.01); *B66B 9/00* (2013.01)

(58) Field of Classification Search
CPC ..... B66B 5/18; B66B 5/22
See application file for complete search history.

(56) References Cited

U.S. PATENT DOCUMENTS 2,274,000 A * 2/1942 Sahlin ..... B66B 5/22 187/350
2,490,653 A * 12/1949 Sahlin ..... B66B 5/18 187/376
3,282,383 A * 11/1966 Chasar ..... B66B 5/22 187/372

(Continued)

FOREIGN PATENT DOCUMENTS

EP 1400476 A1 3/2004

*Primary Examiner* — Minh Truong
(74) *Attorney, Agent, or Firm* — Shumaker Loop & Kendrick; William J. Clemens

(57) ABSTRACT

An elevator car guided at guide rails has a safety brake exerting a braking force on the guide rails in the event of non-compliance of a safety criterion. A housing of the safety brake has a wedge-shaped opening into which the guide rail is introduced, a brake body in the opening between a surface of the housing bounding the opening and a guide surface of the guide rail, an activating mechanism for transmitting an activation force to the brake body to press the brake body against the bounding surface and the guide surface, and a release mechanism connected indirectly or directly with the brake body for keeping the brake body in a rest position against the activation force. The release mechanism includes an articulated arm movable into an extended position for holding the brake body in the rest position and into a folded position for releasing the activation force.

11 Claims, 2 Drawing Sheets

(56) References Cited

U.S. PATENT DOCUMENTS

| | | | | |
|---|---|---|---|---|
| 3,635,315 | A * | 1/1972 | Shalders | B66B 5/22 188/189 |
| 4,449,615 | A | 5/1984 | Beath et al. | |
| 5,228,540 | A * | 7/1993 | Glaser | B66B 5/04 187/355 |
| 5,819,879 | A | 10/1998 | Lang et al. | |
| 6,003,636 | A * | 12/1999 | Yumura | B66B 5/22 187/376 |
| 6,173,813 | B1 * | 1/2001 | Rebillard | B66B 5/06 187/287 |
| 7,377,371 | B2 * | 5/2008 | Reuter | B66D 5/16 188/188 |
| 8,739,937 | B2 * | 6/2014 | Fischer | B66B 7/08 187/393 |
| 2004/0178023 | A1 * | 9/2004 | Maury | B66B 5/04 187/373 |
| 2015/0225207 | A1 * | 8/2015 | Minatta | B66B 19/00 187/377 |
| 2016/0355377 | A1 * | 12/2016 | Husmann | B66B 5/18 |

* cited by examiner

ELEVATOR WITH A SAFETY BRAKE

FIELD

The invention relates to an elevator with a safety brake, particularly a safety brake which can be electrically triggered and which can prevent possible crashing down of a car in a risk-laden operational state of the elevator.

BACKGROUND

Typically, in an elevator a car is moved by means of a drive and guided at guide rails to different access levels of a building. Traction drives or hydraulic drives serve as the drive. A traction drive is composed at least of a motor, a drive pulley and traction means such as, for example, a cable or belt. The motor drives the drive pulley by way of a shaft. The drive pulley in turn transmits traction to the traction means by way of friction forces. A car and a counterweight, which compensates for the gravitational force of the car, are suspended at the traction means. A hydraulic drive comprises at least one hydraulic cylinder and hydraulic piston. A working fluid, which sets the hydraulic piston into a vertical upward or downward movement depending on the pressure built up, is compressed in the hydraulic cylinder. A car placed on the piston is moved correspondingly.

European Safety Standard EN-81 prescribes the use of a safety brake or a so-called catch brake. Such a safety brake is mounted on the car and in the event of drive failure such as, for example, traction means fracture or rapid pressure drop in the hydraulic cylinder can protect the car from a fatal fall. For that purpose the safety brake is traditionally connected with a mechanical speed limiter. This speed limiter triggers the safety brake in the event of excess speed and the safety brake builds up a braking force at the guide rails and thus brings the car to a safe stop.

In more recent times it has been sought to replace mechanical speed limiters and mechanically triggered safety brakes with electronic speed limiters and electronically triggered safety brakes, which are very reliable, compliance-friendly and economically producible.

Patent specification EP 1 400 476 A1 shows an example of such an electronically triggered safety brake. This safety brake can be triggered by a solenoid activated by the speed limiter and has to be capable of fail-safe actuation. For that reason the safety brake is held by the electric motor in a rest position against a spring-biased lever arm. In the event of power failure the energy feed to the solenoid is interrupted and the energy stored in the spring released. Consequently, the safety brake is triggered. The safety brake shown in EP 1 400 476 A1 is distinguished by high trigger reliability. However, this is accompanied by a solenoid which in a rest state has to be constantly supplied with energy and which has to hold the safety brake in a rest position against a biased spring.

SUMMARY

The object of the present invention is thus to develop a safety brake which can be electronically triggered which has low energy consumption even in the rest setting.

This object is fulfilled by an elevator with a car which is guided at guide rails and with a safety brake which is arranged at the car and is designed for the purpose of exerting a braking force on the guide rails in the event of non-compliance of a safety criterion. In that case, the safety brake comprises a brake housing having an opening of wedge-shaped form into which at least a part of a guide rail is introducible, a brake body which is introducible into the wedge-shaped opening between a surface of the brake housing bounding the wedge-shaped opening and a guide surface of the guide rail, an activating mechanism by way of which an activation force is transmissible to the brake body and by way of which the brake body can be pressed against the bounding surface and guide surface, and a release mechanism which is connected indirectly or directly with the brake body and holds the brake body in a rest position against the activation force. The elevator is distinguished by the fact that the release mechanism comprises at least an articulated arm which can brought into an extended position and into a folded position, wherein the articulated arm in the extended position keeps the brake body in the rest position and in the folded position releases the activation force for transmission to the brake body.

The advantage of the invention resides in the fact that by means of the articulated arm the safety brake can be held with little energy in a rest position even against a relatively high activation force. In addition, the release mechanism needs a similarly small amount of energy for release of the activation force, since the articulated arm can be brought from its extended position into a folded position very easily by application of a small laterally acting force.

The release mechanism preferably comprises a setting mechanism which is connected with the articulated arm. In that case the setting mechanism is designed for the purpose of folding the articulated arm from its extended position into its folded position.

For preference the setting mechanism comprises an electric drive, particularly a solenoid or linear motor or the like. This drive is activatable for the purpose of bringing the articulated arm from the extended position into the folded position.

In that case, use can advantageously be made of inexpensive and small commercially available standard drives.

The setting mechanism is preferably connected with a deflectable joint of the articulated arm. Firstly, a particularly simple connection with a setting mechanism can be produced at the joint and secondly the force to be applied is, in the case of introduction of force to the joint, particularly small due to maximum utilization of lever effects.

For preference, the activating mechanism comprises a lever arm which is operatively connected with the brake body and transmits the activation force to the brake body. The ratio between the activation force and the build-up of braking force can be set in particularly simple and reliable manner by way of such a lever arm.

For preference, the lever arm is so connected with the articulated arm that the articulated arm in its extended position holds the lever arm in the rest position against the activation force.

The lever arm is preferably connected with a spring which can be biased and which in biased state transmits the activation force to the lever arm. The spring is a particularly inexpensive component which can store the activation force even over lengthy periods of time and reliably delivers it when required.

For preference, a longitudinal axis of the articulated arm and a longitudinal axis of the spring are oriented in alignment with one another.

The release mechanism is preferably activatable by a safety device, wherein the safety device monitors the safety criterion and in the event of non-compliance of the safety criterion activates the release mechanism in such a way that the activation force is releasable for transmission to the brake body.

Thanks to the electronic triggering of the safety brake, mechanical parts can be minimized. Correspondingly, unit costs and compliance costs can be reduced. In addition, there is the possibility by means of the safety device of staged evaluation of risk potentials of the elevator installation and minimization of the total number of necessary safety braking actions.

The safety criterion preferably represents a car speed, a fluid operating pressure of a hydraulic drive or a state of a support means at which the car is suspended.

For preference the brake body is designed as a roller body or wedge. Such brake bodies reliably wedge between the bounding surface of the brake housing and the guide surface of a guide rail and accordingly exert a sufficient braking force on the guide rail in every case.

DESCRIPTION OF THE DRAWINGS

The invention is clarified and further described in the following by embodiments and on the basis of drawings, in which.

DETAILED DESCRIPTION

Figure 1:
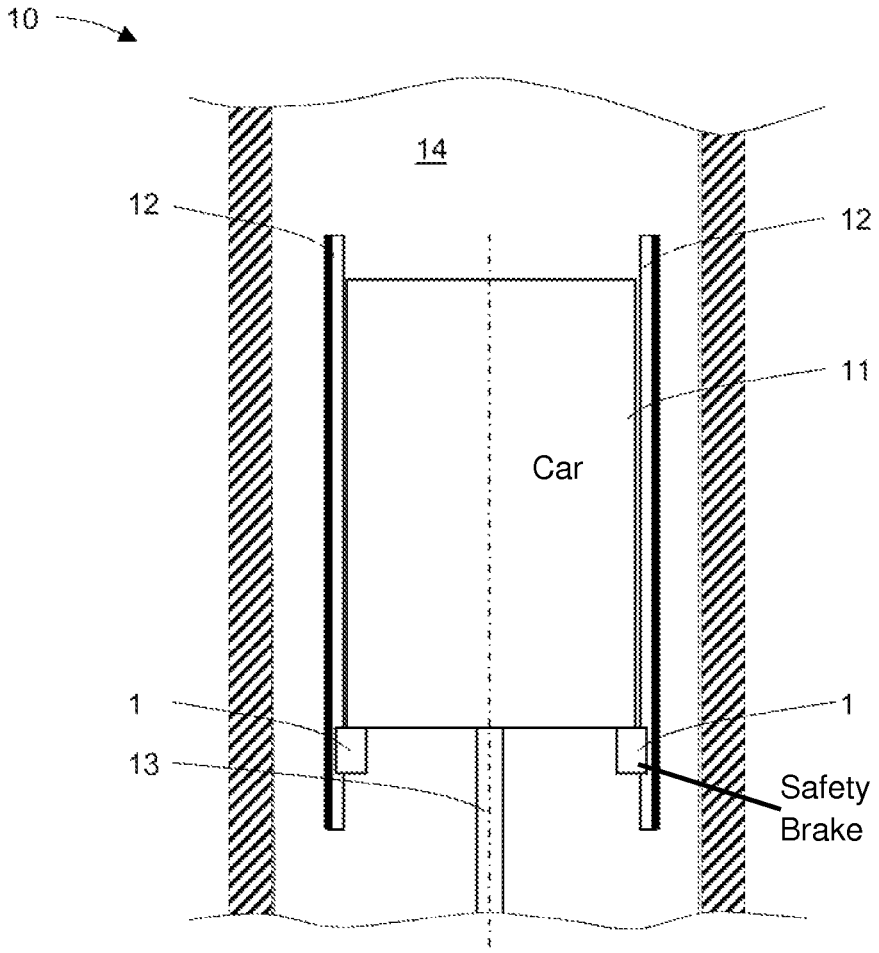
FIG. 1 shows an embodiment of the elevator with a safety brake.

FIG. 1 shows an embodiment of the elevator 10 with a car 11. The car 11 is movable in a shaft 14 along a travel path defined by guide rails 12. For that purpose the elevator 10 has a hydraulic drive. In the illustrated detail merely a hydraulic piston 13 thereof is visible. Not visible is a hydraulic cylinder in which the hydraulic piston 13 is guided and which moves the hydraulic piston 13 vertically upwardly or downwardly. The car 11 is equipped in the lower region with two safety brakes 1. The safety brakes 1 act on the guide surfaces of the guide rails 12 in the event of braking. Obviously, the elevator 10 can be equipped, alternatively to the hydraulic drive, with a traction drive, which comprises traction means at which the car 11 and the counterweight are suspended and a motor which is in operative contact with the traction means by way of a drive pulley. Cables, belts or the like are usable as traction means.

Figure 2:
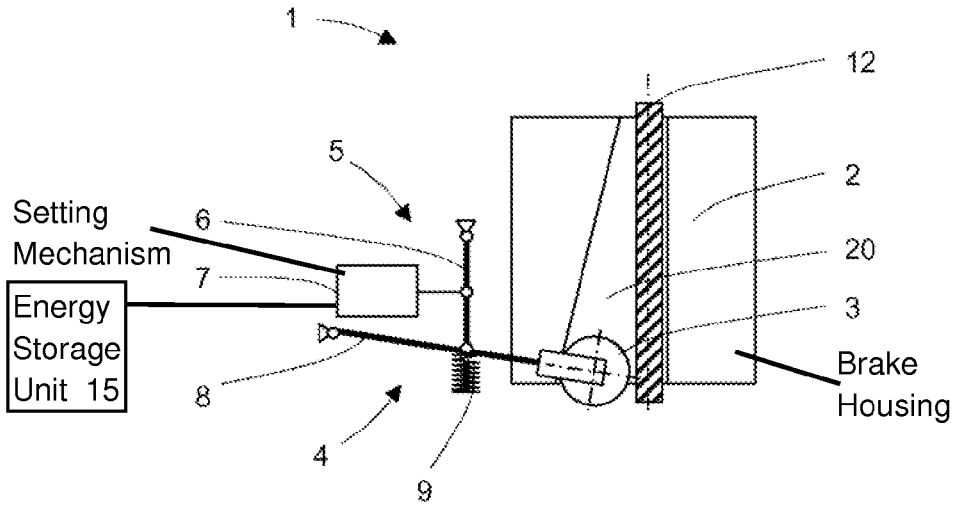
FIG. 2 shows a schematic view of the safety brake in a rest position.

The safety brake 1 is illustrated in a rest position in FIG. 2. The safety brake comprises a brake housing 2, a brake body 3, an activating mechanism 4 and a release mechanism 5.

The brake housing 2 has an opening 20 into which at least a part of a guide rail 12 is introducible. The guide rail 12 is usually produced as a T-section. The guide rail 12 can obviously also be designed as a U-section or other suitable sectional shape. In the example illustrated here the end flange, which faces the car 11, of the guide rail 12 is introduced into the opening 20 of the brake housing 2. The opening 20 is bounded on one side by a first surface extending parallel to the guide rail 12 and on the other side by a second surface which together with the first surface defines a space tapering upwardly in wedge shape.

The brake body 3 is held in a lower rest position in this space. The brake body is here designed as a roller body which after activation of the brake is pressed against the second surface of the brake housing 2 and a guide surface of the guide rail 12 and, in the case of vertically downwardly directed movement direction of the car 11, further wedges between the second surface and the guide surface. In that case the guide rail 12 is clamped between the first surface of the brake housing 2 and the brake body 3. The safety brake 1 thus exerts a braking force on the guide rail 12. In departure from the roller body the brake body 3 can obviously also be designed to be wedge-shaped or to have another suitable shape.

The activating mechanism 4 comprises a lever arm 8 and a compression spring 9, which is shown in FIG. 2 in a biased position. The lever arm 8 is mounted at a first end to be pivotable with respect to the brake housing 2. The brake body 3 is attached to its second, freely movable end. The compression spring 9 is placed in a middle region of the lever arm 8. The compression spring 9 is arranged to be able to be pressed between the lever arm 8 and the brake housing 2 and thus exerts an activation force on the lever arm 8.

The release mechanism 5 comprises an articulated arm 6 and a setting mechanism 7. The articulated arm 6 is composed of two rod elements which are connected by way of a deflectable joint. A first end of the articulated rod 6 is mounted to be pivotable with respect to the brake housing 2. A second end is pivotably connected with the lever arm 8. The setting mechanism 7 is attached to the brake housing 2 and connected with the lever arm 8 by way of the joint between the rod elements. The setting mechanism 7 holds the articulated arm 6 in an extended position in the illustrated FIG. 2. In the extended position the articulated arm 6 opposes the activation force of the spring 9 and thus holds the brake body 3 in the rest position. The setting mechanism 7 can be realized as a solenoid, linear motor or the like. In that case, a movable element of the setting mechanism 7 is connected with the joint of the articulated arm 6.

In addition, the setting mechanism 7 is activatable by a safety device (not shown). This safety device comprises at least one speed limiter which in the case of detection of excess speed of the car 11 activates the setting mechanism 7 in such a way that the release mechanism 5 releases the activation force. The safety device can also comprise a pressure sensor which in the case of a hydraulically driven elevator 10 monitors the pressure of the working fluid in the hydraulic cylinder and in the event of a critical sub-pressure similarly activates the setting mechanism 7 for release of the activation energy. The same applies to a further sensor of the safety device, which monitors a traction means and in the case of fracture of the traction means correspondingly activates the setting mechanism 7. Further possibilities are available to the expert to monitor other safety criteria of the elevator 10 by means of sensors, switches, contacts or the like and in the case of non-fulfilment of the safety criterion to activate the setting mechanism 7 in the above sense so as to transfer the elevator 10 to a safe state or trigger the safety brake 1.

Figure 3:
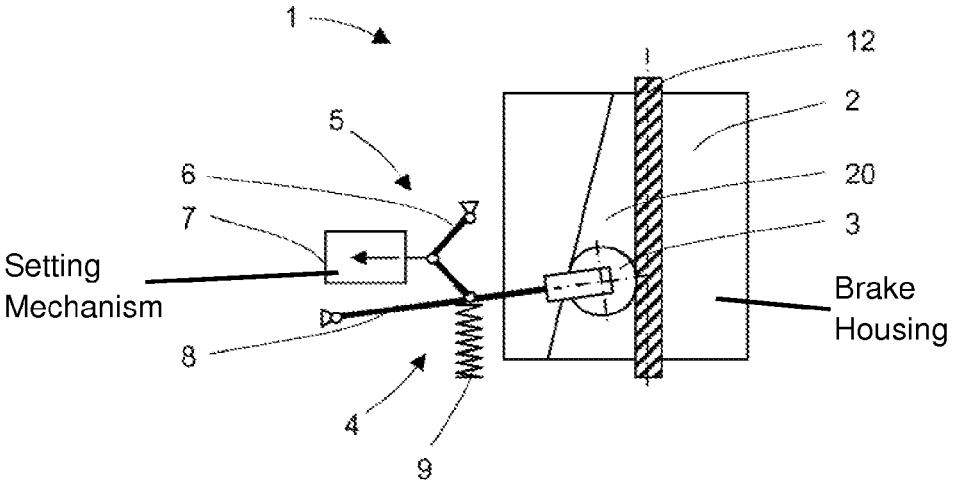
FIG. 3 shows a schematic view of the safety brake in an activated position.

FIG. 3 shows the safety brake 1 in an activated state. For activation of the safety brake 1, the setting mechanism 7 of the release mechanism 5 is activated by the safety device as described above. The setting mechanism 7 brings the articulated rod 6 out of its extended position into a folded position. The force acting by the setting mechanism 7 on the folding mechanism 6 is illustrated in FIG. 3 by an arrow.

In the folded position of the articulated rod 6 the energy stored in the spring 9 is released as activation force, wherein the activation force in the depicted illustration is transferred vertically upwardly to the lever arm 8. The lever arm 8 is set into a rotational movement upwardly about its bearing point by the activation force and transfers the activation force to the brake body 3. As a consequence, the brake body 3 is pressed against the second surface of the brake housing 2 and the guide surface of the guide rail 12. In the case of a downwardly directed movement of the cage car 11 the brake body 3 wedges further between the said surfaces and thus clamps the guide rail against the first surface of the brake housing 2. The braking force applied to the guide rail 12 ultimately brings the car 11 to a stop.

The safety brake 1 can obviously also prevent an impermissible upwardly directed travel. For that purpose the safety brake 1 is arranged with vertical mirror inversion on the car 11. In that case, the brake body after release of the activation force is pressed vertically downwardly against the second surface of the brake housing and the guide surface of the guide rail and wedges, in the event of a vertically upwardly directed movement of the car 11, between the said surfaces. Also in this situation, the brake body ultimately wedges the guide rail 12 against the first surface of the brake housing and thus brings the car 11 to a stop.

For reliable actuation of the setting mechanism 7 the release mechanism 5 comprises an energy storage unit 15 (illustrated in FIG. 2) such as a battery, a further spring or the like. This energy storage unit ensures that the safety brake 1 remains activatable even in the case of power failure.

The release mechanism 5, particularly the deflectable joint of the articulated arm 6, can optionally comprise an abutment at one side. This means that the joint in the extended position of the articulated arm opens only in one rotational direction. In that case it is particularly advantageous if the abutment is so arranged with respect to a movement of the joint that a maximum movement of the joint towards the abutment leads to slight over-extension of the articulated arm 6. In the depicted illustration in FIG. 3 the abutment is on the side remote from the setting mechanism 7. The articulated arm 6 can thus be buckled by a pulling movement of the setting mechanism at the joint.

With particular advantage the release mechanism 5 optionally comprises the further spring which exerts a release force on the articulated arm 6 in the setting direction of the setting mechanism 7. In this embodiment the setting mechanism 7 in the rest position of the safety brake 1 counteracts, by a countering force, the release force of the further spring and holds the articulated arm 6 in its extended position under pressure against the abutment of the deflecting joint.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator including a car which is guided at guide rails and a safety brake arranged at the car for exertion of a braking force on the guide rails in an event of non-compliance of a safety criterion, the safety brake comprising:

a brake housing having an opening of wedge-shaped form into which at least a part of one of the guide rails is introduced;

a brake body positioned in the wedge-shaped opening between a surface of the brake housing bounding the wedge-shaped opening and a guide surface of the one guide rail;

an activating mechanism for transmitting an activation force to the brake body to press the brake body against the surface bounding the wedge-shaped opening and the guide surface;

a release mechanism connected with the brake body for holding the brake body in a rest position against the activation force, the release mechanism including an articulated arm movable between an extended position and a folded position, wherein the articulated arm in the extended position holds the brake body in the rest position and in the folded position releases the activation force for transmission to the brake body, and the activating mechanism including a lever arm connected with the brake body for transmitting the activation force to the brake body, the lever arm being connected with the articulated arm whereby the articulated arm in the extended position holds the lever arm in the rest position against the activation force; wherein the lever arm is connected with a spring of the activating mechanism, which is biased to transmit the activation force to the lever arm; and wherein a longitudinal axis of the articulated arm and a longitudinal axis of the spring are oriented in alignment to each other.

2. The elevator according to claim 1 wherein the release mechanism includes a setting mechanism connected with the articulated arm, wherein the setting mechanism is actuatable for folding the articulated arm from the extended position into the folded position.

3. The elevator according to claim 2 wherein the setting mechanism includes an electric drive which is activatable for bringing the articulated arm from the extended position into the folded position.

4. The elevator according to claim 3 wherein the electric drive is one of a solenoid and a linear motor.

5. The elevator according to claim 2 wherein the setting mechanism is connected with a deflectable joint of the articulated arm.

6. The elevator according to claim 1 wherein the release mechanism includes an energy storage unit for activating the safety brake upon a failure of electrical power to the elevator.

7. The elevator according to claim 6 wherein the energy storage unit is one of a battery and a further spring.

8. The elevator according to claim 7 wherein the release mechanism includes a setting mechanism connected with the articulated arm, wherein the setting mechanism is actuatable for folding the articulated arm from the extended position into the folded position, wherein the energy storage unit exerts a release force on the articulated arm through the setting mechanism, the setting mechanism in the rest position of the safety brake counteracts, by a counter-force, the release force of the energy storage unit and holds the articulated arm in the extended position.

9. The elevator according to claim 1 wherein that the release mechanism is activatable by a safety device of the elevator, wherein the safety device monitors the safety criterion and in the event the non-compliance of the safety criterion activates the release mechanism to release the activation force for transmission to the brake body.

10. The elevator according to claim 9 wherein the safety criterion represents one of a car speed, a fluid operating pressure of a hydraulic drive and a state of a support device at which the car is suspended.

11. The elevator according to claim 1 wherein the brake body is formed as a roller body or a wedge.

* * * * *